US011168906B2

(12) United States Patent
King, Jr.

(10) Patent No.: US 11,168,906 B2
(45) Date of Patent: Nov. 9, 2021

(54) EXHAUST VENT

(71) Applicant: Roof Goose Vent LLC, North Kingstown, RI (US)

(72) Inventor: Jack F. King, Jr., North Kingstown, RI (US)

(73) Assignee: Roof Goose Vent, LLC, North Kingstown, RI (US)

( * ) Notice: Subject to any disclaimer, the term of this patent is extended or adjusted under 35 U.S.C. 154(b) by 293 days.

(21) Appl. No.: 16/224,236

(22) Filed: Dec. 18, 2018

(65) Prior Publication Data

US 2019/0195520 A1 Jun. 27, 2019

Related U.S. Application Data

(60) Provisional application No. 62/609,122, filed on Dec. 21, 2017.

(51) Int. Cl.

| | |
|---|---|
| ***F24F 7/02*** | (2006.01) |
| ***F24F 7/00*** | (2021.01) |
| ***F24F 13/14*** | (2006.01) |

(52) U.S. Cl.

CPC ..... *F24F 7/02* (2013.01); *F24F 13/14* (2013.01); *F24F 2007/001* (2013.01); *F24F 2221/52* (2013.01)

(58) Field of Classification Search

CPC combination set(s) only.

See application file for complete search history.

(56) References Cited

U.S. PATENT DOCUMENTS

| | | | |
|---|---|---|---|
| 4,442,643 | A | 4/1984 | Stadheim |
| 5,226,263 | A | 7/1993 | Merrin et al. |
| 5,344,363 | A | 9/1994 | Pollock |
| 5,547,422 | A | 8/1996 | Seboldt |
| 5,632,678 | A | 5/1997 | Doelfel |
| 5,722,181 | A | 3/1998 | Meyer |
| D397,431 | S | 8/1998 | Meyer |
| 5,916,023 | A | 6/1999 | Meyer |
| 6,183,360 | B1 | 2/2001 | Luter, II et al. |
| 6,185,885 | B1 * | 2/2001 | Thaler ..... E04D 13/1407 285/42 |
| 6,299,529 | B1 | 10/2001 | Preston |
| 6,302,788 | B1 | 10/2001 | Gagnon |
| 6,370,794 | B1 | 4/2002 | GregoryTuggle |
| 6,378,227 | B1 | 4/2002 | Bradford |
| 6,640,461 | B1 | 11/2003 | Berger |
| 6,994,622 | B2 | 2/2006 | Koessler |
| 8,272,186 | B2 | 9/2012 | Manning |
| 8,336,923 | B2 | 12/2012 | Vautour |
| 8,490,351 | B1 | 7/2013 | Scott |

(Continued)

FOREIGN PATENT DOCUMENTS

| | | | |
|---|---|---|---|
| CA | 2326371 | A1 | 5/2002 |
| CA | 2857112 | A1 | 1/2016 |

(Continued)

*Primary Examiner* — Steven B McAllister
*Assistant Examiner* — Elizabeth M. May
(74) *Attorney, Agent, or Firm* — Breiner & Breiner, L.L.C.

(57) ABSTRACT

The present invention is directed to an exhaust vent assembly including a sleeve, a neck, a damper in the neck, a cap attached to the neck and a collar. The exhaust vent assembly may be configured without any tools and without any penetrative fasteners.

15 Claims, 7 Drawing Sheets

(56) References Cited

U.S. PATENT DOCUMENTS

| | | | | |
|---|---|---|---|---|
| 8,845,405 | B2 | 9/2014 | Greenberg | |
| 8,845,406 | B2 | 9/2014 | McIver | |
| 9,227,095 | B2 | 1/2016 | Tamburro | |
| 9,228,689 | B1 | 1/2016 | Cline et al. | |
| 9,328,514 | B1 * | 5/2016 | Thompson | E04D 13/143 |
| D796,663 | S | 9/2017 | Mitchell | |
| 2006/0025067 | A1 * | 2/2006 | Koessler | F24F 7/02 454/359 |
| 2011/0312262 | A1 | 12/2011 | Grandmaison | |
| 2012/0258656 | A1 | 10/2012 | Raimondi | |
| 2013/0189915 | A1 * | 7/2013 | Hazard | F23J 13/06 454/47 |
| 2014/0170962 | A1 | 6/2014 | Carter | |
| 2016/0131392 | A1 | 5/2016 | Mantyla et al. | |
| 2016/0305686 | A1 | 10/2016 | Plummer | |
| 2017/0051929 | A1 | 2/2017 | Ramsay et al. | |
| 2017/0191683 | A1 | 7/2017 | Seeman | |

FOREIGN PATENT DOCUMENTS

| | | | |
|---|---|---|---|
| JP | 11-071870 | A | 3/1999 |
| KR | 100963486 | B1 | 6/2010 |

* cited by examiner

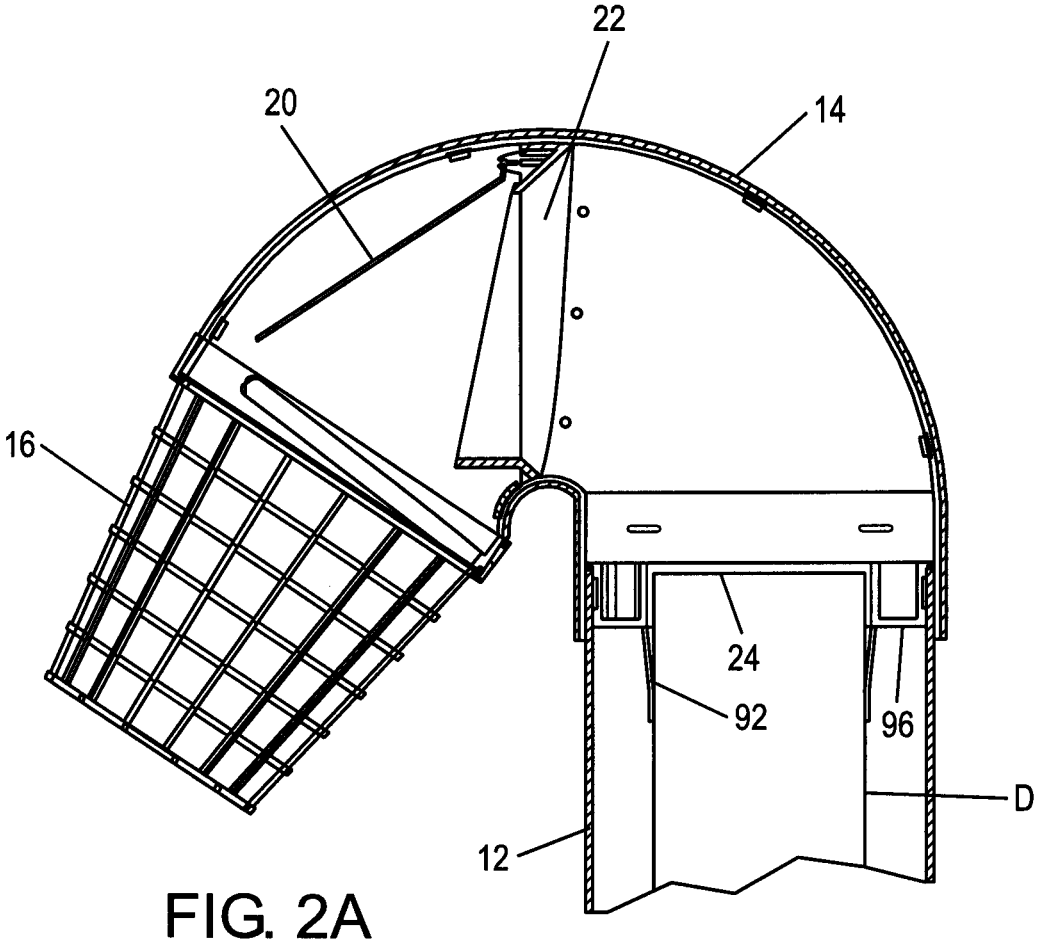
FIG. 2A
FIG. 2B
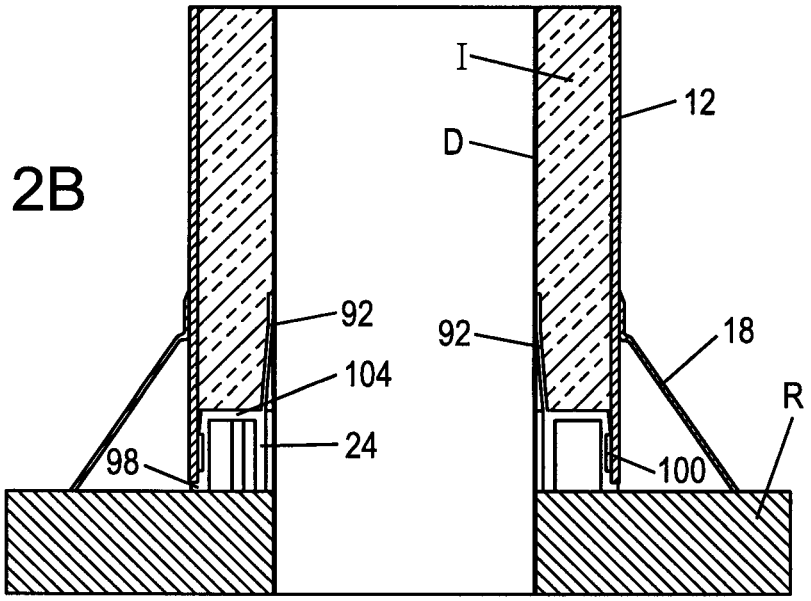

FIG. 5
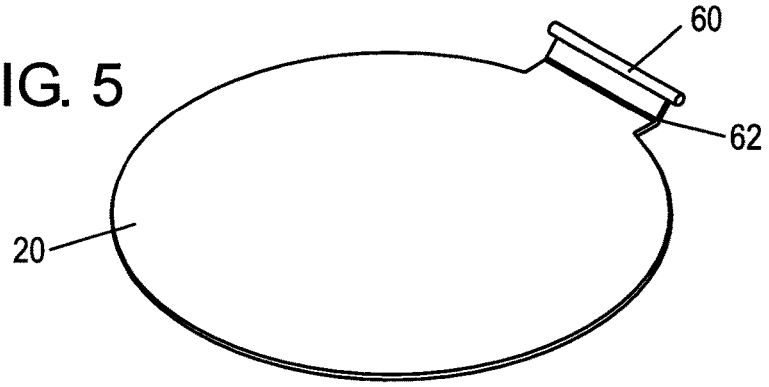
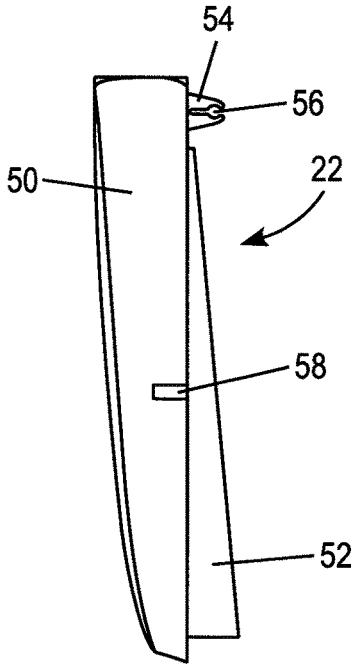
FIG. 6A
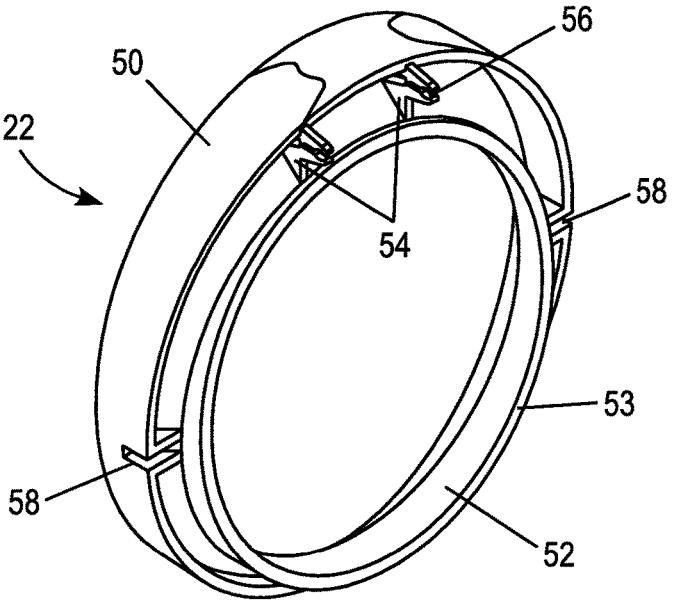
FIG. 6
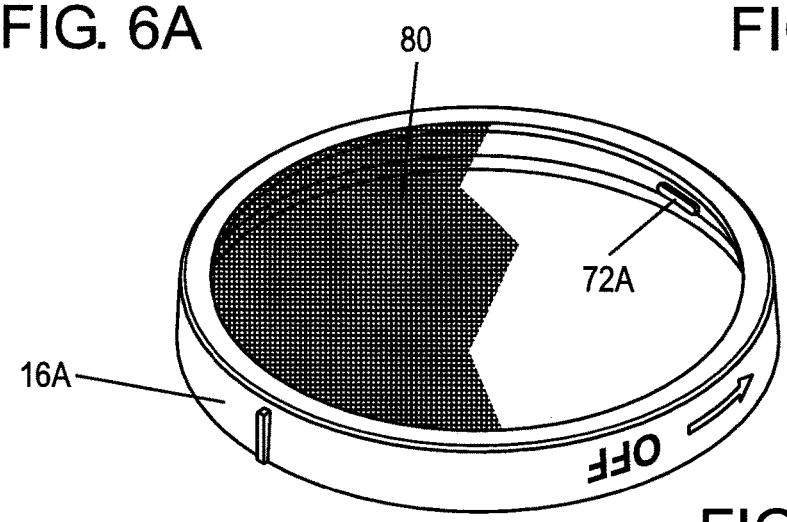
FIG. 8

EXHAUST VENT

RELATED APPLICATION

This application claims benefit of U.S. Provisional Application Ser. No. 62/609,122, filed Dec. 21, 2017, entitled "Exhaust Vent," which application is incorporated herein by reference in its entirety.

FIELD OF THE INVENTION

The present invention relates to an exhaust vent. More particularly, the invention relates to an exhaust vent for use on a flat roof for venting of a dryer, a bathroom, a kitchen or the like.

BACKGROUND OF THE INVENTION

The invention is directed to exhaust vents for use on flat roofs such as in multi-family residential construction, restaurants and commercial buildings. Contractors often bring individually a dryer exhaust duct or a bathroom exhaust duct or a kitchen exhaust duct up through a flat roof individually using single wall galvanized steel ducts, e.g. 28 gauge galvanized steel. The termination of the duct is problematic because it needs to be weatherproof for protection of the exposed galvanized duct, flashed into the surrounding roof membrane, wind protected, insect or bird proof and still allow maximum design free air flow. All terminations on a flat roof must rise vertically some distance to satisfy code requirements for height above the roof to allow for protection from snow, rain pooling or debris being pulled into the duct. In the case of an exhaust duct, the exhaust vent requires a backdraft damper which necessities use of a separate and distinct assembly inserted into a field assembly of 90 degree sheetmetal elbows or using a typical sidewall vent adapted to a separate 90 degree elbow. This internal backdraft assembly, also known as a butterfly damper, diminishes the free air due to it being an independent assembly and consisting of two separate spring loaded wings folding inward from the centerline. These butterfly dampers restrict the free area more than an integral single plane backdraft damper. This field assembly is unsightly looking and creates many radial and longitudinal seams that need to be weatherproofed. Mastics for weatherproofing such seams are labor-intensive and subject to degradation over time. Mastics also look unsightly as they are different colors than the underlying metal duct and, therefore, present an unfinished appearance. Similarly, caulks for such seams are difficult to apply and paint over. Additionally, the application of all such seam coverings require the appropriate weather conditions to apply and dry the covering to a manufacturers' specifications. Moreover, these known assemblies use products from multiple manufacturers, require numerous field assembled joints and are labor intensive and expensive to install.

In the case of a clothes dryer exhaust vent, the 2015 International Mechanical Code ("IMC") does not allow penetrative fasteners to be used. This is specified in section 504.4, page 5-32 stating that ducts shall not be connected or installed with sheetmetal screws or other fasteners that will obstruct the exhaust flow. Therefore, current industry practice is to use mastics or very short screws to keep the assembly together. However, such penetrative fasteners are contrary to the intent of the code.

In a dryer exhaust vent, the IMC specifically mandates that the termination of a dryer exhaust cannot obstruct the free area of the exhaust duct it serves and does not allow a screen on the termination of the duct. This is specified, for example, in the 2015 IMC at section 504.4, page 5-33, providing that a full opening in exhaust systems is considered to be an opening having no dimensions less than the diameter of the exhaust duct. The 2018 IMC goes further in defining acceptable openings as specified at section 504.4.1, page 49, stating that the passageway of dryer exhaust duct terminals shall be undiminished in size and shall provide an open area of not less than 12.5 square inches. Further, in a dryer exhaust vent assembly, the IMC does not allow a screen on the termination of the duct. This creates an opening for birds to nest in exhaust vent assemblies using an internal backdraft damper due to the damper being inset into the duct. Reference is made herein to different versions of the IMC as certain jurisdictions may not have adopted the latest version of the IMC.

Various types of exhaust venting terminations are known such as roof jacks, sidewall vent hoods and field assembled gooseneck type assemblies. These known venting solutions present problems in installation and use. Devices such as roof jacks require expensive separate roof curbs to be flashed into a roof and then the roof jack to be flashed into the curb in order to gain the required height above the flat roof. This is very labor intensive as each layer (curb) and then roof jack requires coordination and work by separate trades in sequential order. Side wall vent hoods require an exposed round duct to be run vertically above the roof and then turned 90 degrees to allow the side wall vent hood to be orientated properly. This type of assembly requires penetrative fasteners to hold the cap in place as well as weatherproofing. Field built gooseneck assemblies also require vertical rise duct which then need weatherproofing and numerous field assemblies to be combined into a functional exhaust vent. Field designed assemblies lack any consistency or quality control and vary greatly in their effectiveness and cost. Additionally, such devices may have passageways which diminish in size and thereby create back pressure decreasing the efficiency of the exhaust vent.

The above and other shortcomings of known exhaust vents are addressed by the present invention.

SUMMARY OF THE INVENTION

A primary object of the present invention is to provide a new and useful exhaust vent.

Another primary object of the invention is to provide for a duct vent termination for use on a flat roof.

Another primary object of the invention is to provide an exhaust vent for a dryer exhaust or a bathroom exhaust or a kitchen exhaust for use on a flat roof.

Another primary object of the invention is to provide an exhaust vent for a dryer exhaust, bathroom exhaust, kitchen exhaust, or fresh air inlet for use on a flat roof which is light weight, simple in construction, does not require separate weatherproofing or painting and is easy to install.

Another primary object of the invention is to provide an exhaust vent, preferably waterproof, that can be installed during construction prior to the roof membrane and which exhaust vent is weatherproof and can be flashed directly to by the roofer.

Another primary object of the invention is to allow commonly used round vent ducting to be weatherproofed and terminated without penetrative fasteners.

Another primary object of the invention is to provide an exhaust vent which allows common round duct risers to be insulated within an annular space created by a weatherproof sleeve of the exhaust vent.

Another primary object of the invention is to provide an exhaust vent which facilitates the installation of the exhaust vent from below a roof by virtue of using a sleeve which surrounds a duct wherein the sleeve has four mounting apertures at one end of the sleeve and which are aligned with four locking channels at the other end of the sleeve. This allows for multiple exhaust vent assemblies to be uniformly oriented in the same direction.

Another primary object of the invention is to provide an exhaust vent having a neck and a sleeve wherein the neck may be mounted to the sleeve without tools and rotated 360 degrees on the sleeve in 90 degree increments. This tool-less adjustability allows an installer a large margin of error for code mandated clearances to other rooftop terminations or equipment as well as the ability to place the exhaust vent neck in the best position for the conditions on the roof.

Another primary object of the invention is to allow preexisting round ducts on a flat roof to be retrofitted with a weatherproof termination that counter-flashes and protects existing ducts without penetrative fasteners regardless of weather conditions.

Another primary object of the invention is to provide an exhaust vent which meets code requirements of no penetrative fasteners, including in the IMC. This is achieved by the exhaust vent of the invention which is easily installed or removed without tools, thereby providing for ease of cleaning and unobstructed duct access.

Another primary object of the invention is to provide an exhaust vent having a cap which functions as a bird guard for dryer vent applications and which is easily removeable without tools.

Another primary object of the present invention is to provide an exhaust vent, especially useful for dryers, having a slightly oversized round duct long radius gooseneck termination which provides approximately 8% greater free area than using existing 90 or 45 degree metal fittings. This extra free area and seamless smooth internal surface may mitigate the friction loss of an internal damper and improve the installed performance of the underlying exhaust duct.

Another primary object of the invention is to provide an exhaust vent which is a color coordinated and having a horizontal female neck over a male sleeve, the neck and sleeve being connected by a twist lock mechanism.

Another primary object of the invention is to provide an exhaust vent which provides an elegant solution to duct cleaning and inspection from a roof. The exhaust vent includes a neck assembly having a backdraft damper integral to itself and is easily removed and reinstalled without tools or degradation of mastics or caulks.

Another primary object of the invention is to provide an exhaust vent which reduces the labor and material costs associated with installing existing exhaust vents.

Another primary object of the invention is to provide an exhaust vent having a seamless smooth solvent weldable surface which a roof membrane may be flashed to.

Another primary object of the invention is to provide an exhaust vent having a larger internal backdraft damper protected from the elements and made more effective due to its eccentric position within the exhaust vent neck's internal elevated position and, therefore, being better protected from the wind.

Another primary object of the invention is to provide an exhaust vent having a plastic internal eccentric backdraft damper within a plastic exhaust vent assembly, thereby not being as noisy as typical metal backdraft dampers within typical metal elbows.

Another primary object of the invention is to provide an entire corrosion proof nonmetallic exhaust vent assembly.

The present invention is directed to an exhaust vent comprising a sleeve, a neck, a damper in the neck, a cap attached to the neck and a storm collar. The invention may further utilize a bushing to provide further benefit to the exhaust vent.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

Referring to the drawings:

FIG. 2A is an enlarged view of the top of the exhaust vent shown in FIG. 2.

FIG. 2B is an enlarged view of the bottom of the exhaust vent shown in FIG. 2.

FIG. 5 shows the damper which is inside the neck of the exhaust vent of FIG. 1.

FIG. 6 shows a perspective view of the damper ring located in the neck of the exhaust vent of FIG. 1 and to which the damper of FIG. 5 is attached.

FIG. 6A shows a side view of the damper ring of FIG. 6.

FIG. 8 shows a perspective view of an alternative cap having a screen for the exhaust vent of FIG. 1 and useful in preventing insects from entering the exhaust vent.

DETAILED DESCRIPTION OF THE PREFERRED EMBODIMENTS

Figure 1:
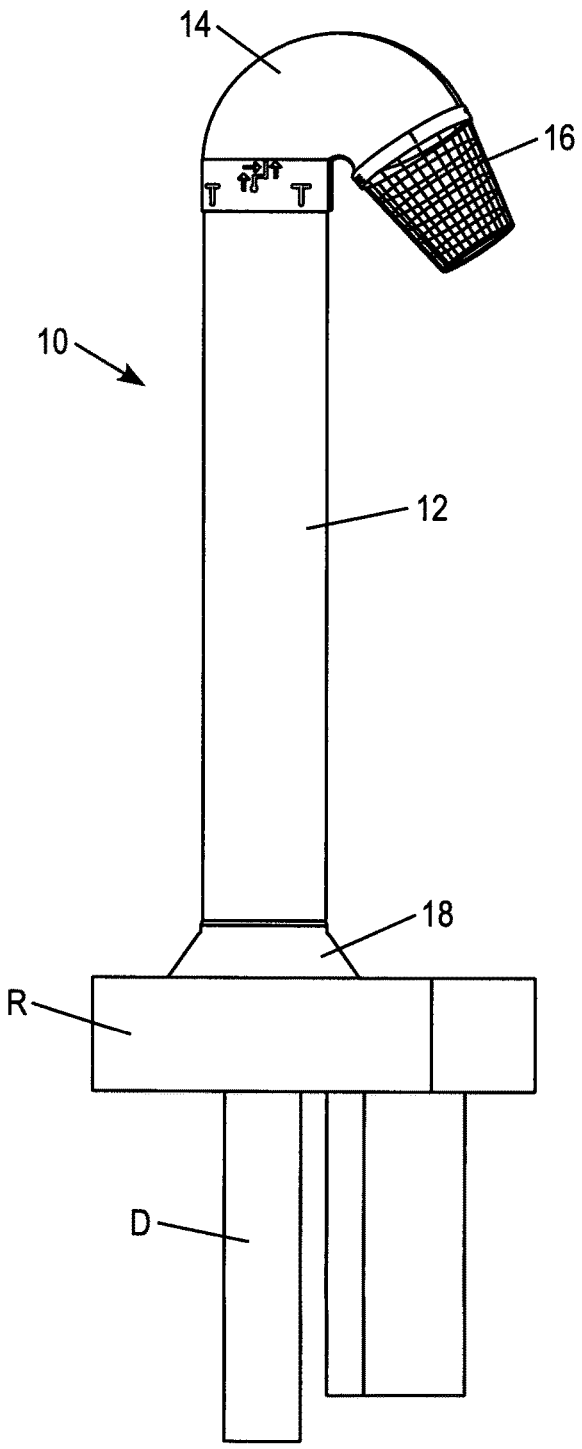
FIG. 1 is a plan view of the exhaust vent of the present invention.

Referring to FIG. 1, there is shown the exhaust vent of the present invention. The exhaust vent is useful for exhaust terminations in flat roof construction for dryer exhaust, bathroom exhaust, kitchen exhaust and the like. The invention will be explained herein for convenience with respect to a dryer exhaust. However, the invention is applicable to vent exhausts from other applications.

Figure 2:
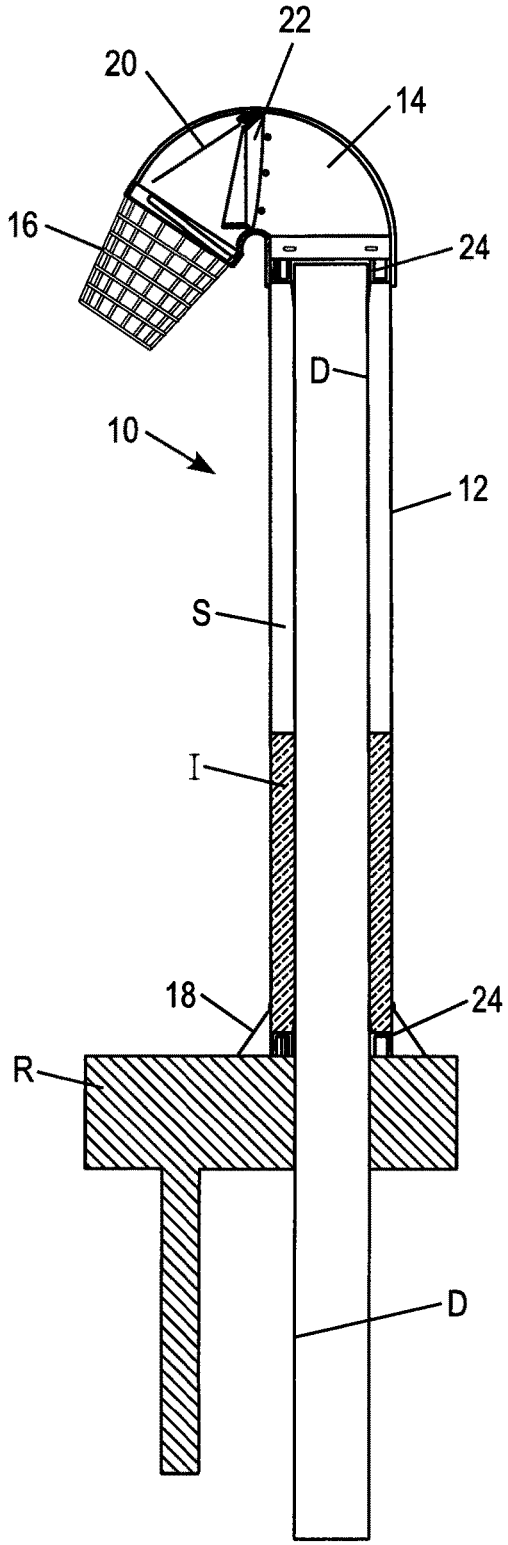
FIG. 2 is a cross-section of the exhaust vent of FIG. 1.

Referring to FIG. 1, there is shown a plan view of the exhaust vent 10 for a dryer exhaust. There is shown a flat roof R and a four inch galvanized steel duct D which is attached a dryer exhaust (not shown). The duct D may extend above the roof R generally from about 18 inches to about 42 inches as shown in FIG. 2. In the presently preferred embodiment, the primary components of the invention comprise a sleeve 12, a neck 14, a cap 16, a storm collar 18, a damper 20 and a damper ring 22. In certain applications of the invention, the exhaust vent assembly may include a bushing 24. Each of these components will now be described in greater detail.

Figure 10:
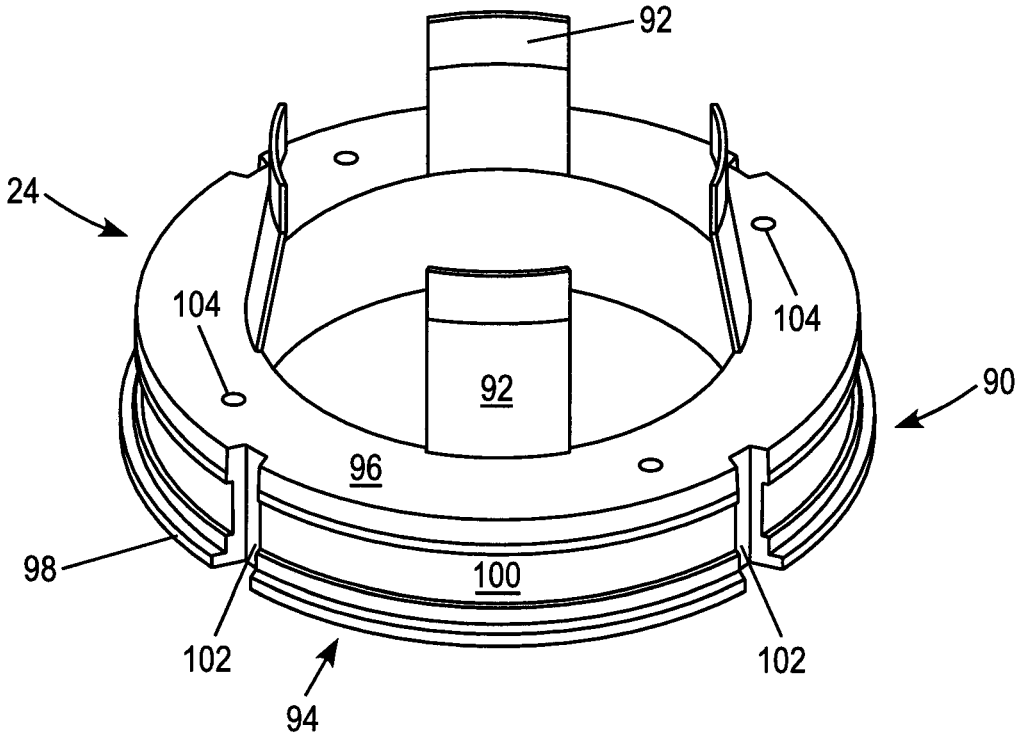
FIG. 10 shows a perspective view of a bushing which may be used in certain embodiments of the exhaust vent of the invention and shown in FIGS. 2, 2A and 2B.

As seen generally in FIG. 1, the round galvanized duct D will extend through the roof R, generally from about 18 inches to about 42 inches. In one preferred embodiment, sleeve 12 may be the same length as the length that the galvanized duct extends from the roof. The sleeve 12 may fit snuggly over the galvanized duct D or be spaced apart from duct D as shown in FIG. 2, thereby providing a space S between sleeve 12 and duct D. One reason for having a space S between sleeve 12 and duct D is to allow for insulation I to be inserted in this space as partially shown in FIG. 2. Another reason for leaving a space S is to allow for the use of a larger diameter neck 14 which provides more free space for air flow for venting, among other things, a dryer exhaust, thereby complying with IMC requirements. When a space between sleeve 12 and duct D is desired, it is preferred to use a bushing 24 as shown in FIGS. 2 and 10 and discussed hereafter.

Figure 3:
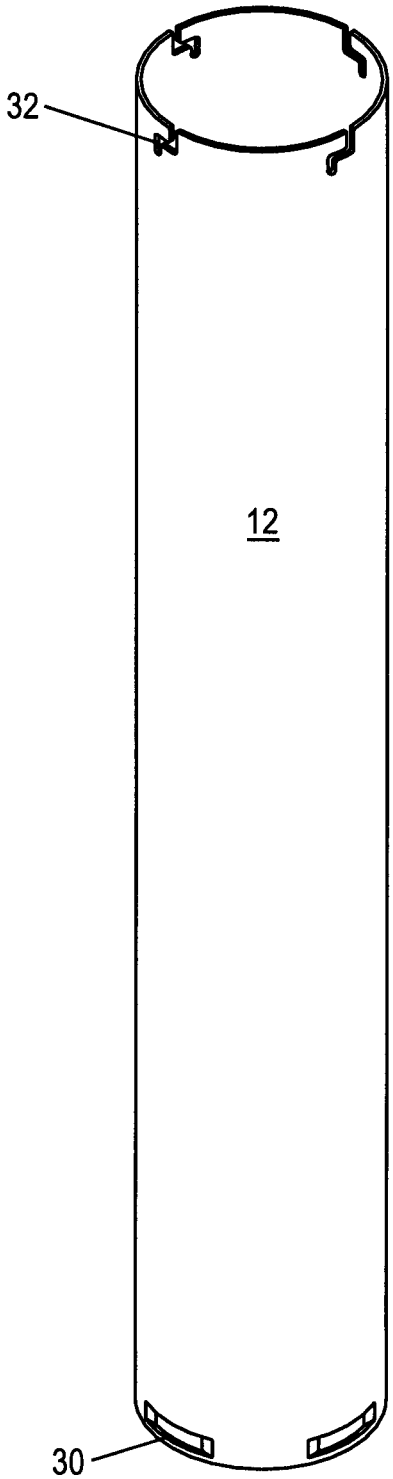
FIG. 3 shows the sleeve of the exhaust vent of FIG. 1.
Figure 3A:
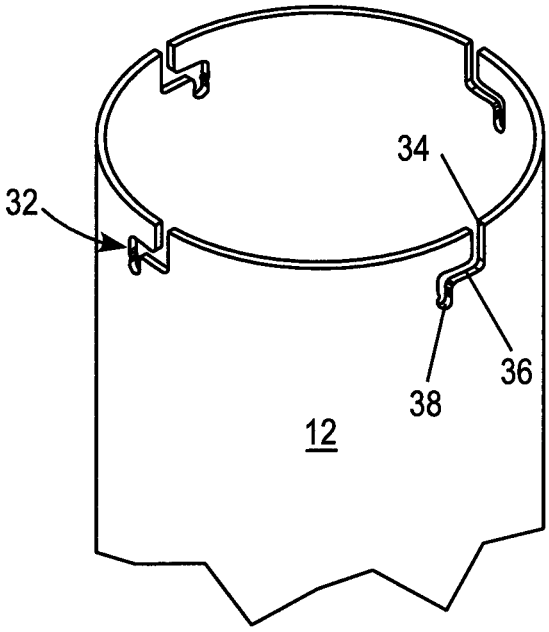
FIG. 3A is an enlarged view of the top of the sleeve of FIG. 3.
Figure 3B:
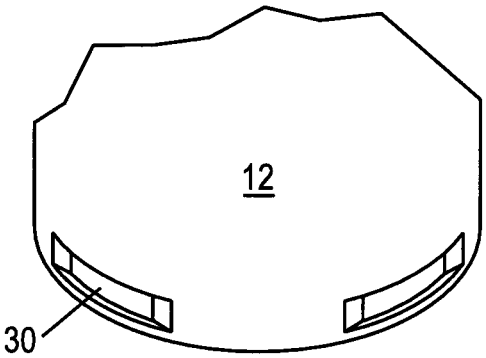
FIG. 3B is an enlarged view of the bottom of the sleeve of FIG. 3.

Sleeve 12 is preferably made of plastic such as polyvinylchloride (PVC) or high density polyethylene (HDPE). This provides for, among other things, lightweight construction, weatherproof construction, UV stabilized construction, simple installation and inexpensive manufacture. Referring to FIGS. 1, 2 and 3, sleeve 12 includes a plurality of apertures 30 as shown in FIGS. 3 and 3B and a plurality of twist lock channels 32 as shown in FIGS. 3 and 3A and discussed hereafter. In a preferred embodiment, these are four apertures 30 and four twist lock channels 32. The twist lock channels 32 comprise three segmented sections 34, 36 and 38. Apertures 30 are aligned with locking channels 32 to provide for consistently orienting the direction of the neck 14 when having a plurality of exhaust vents 10. Specifically, when apertures 30 in a plurality of exhaust vents 10 are all positioned the same, e.g. oriented square to an exterior wall, all locking channels 32 of the multiple exhaust vents 10 will be in the same position for receiving neck 14. This will allow for orienting all of the necks 14 in the same direction, if desired.

Sleeve 12 is secured to the galvanized duct D with a strapping band (not shown) or a plurality strapping bands. This provides for a nonintrusive connection of sleeve 12 to galvanized duct D. The strapping band is placed around the sleeve such that the strapping band will be laced through apertures 30 and engage the duct D, providing for a secure attachment of sleeve 12 to duct D.

Figure 4:
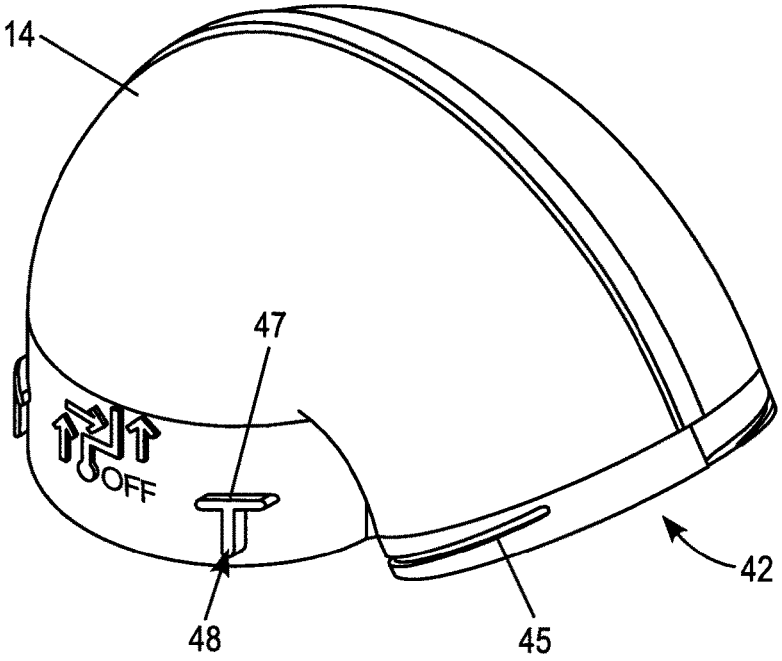
FIG. 4 shows a perspective view of the neck of the exhaust vent of FIG. 1.
Figure 4A:
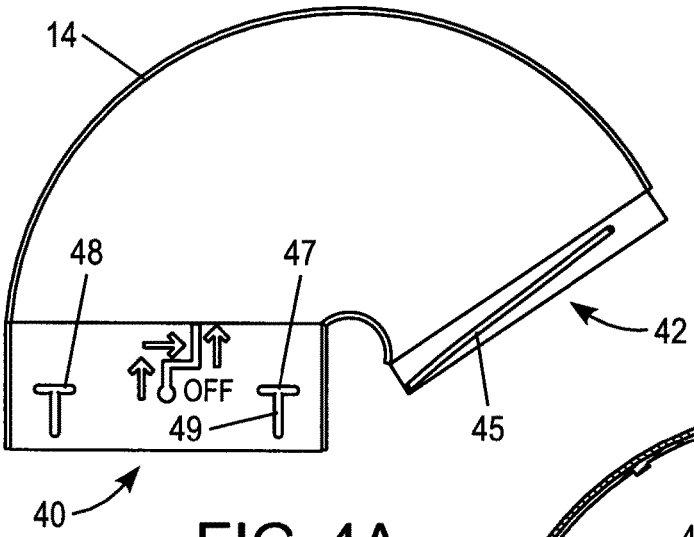
FIG. 4A shows a side view of the neck of FIG. 4.
Figure 4B:
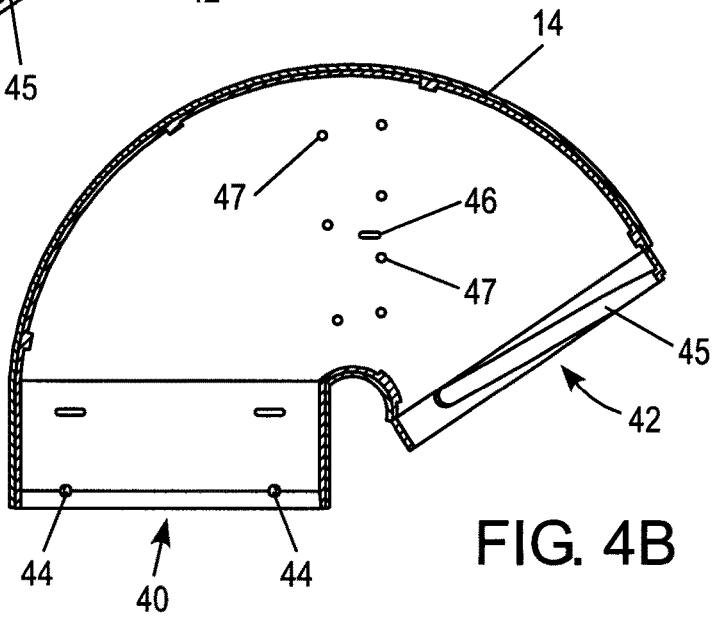
FIG. 4B shows a cross-section of the neck of FIG. 4A.

Referring to FIGS. 1, 2, 4, 4A and 4B, attached to sleeve 12 is a neck 14. Neck 14 is preferably a gooseneck shape as shown in the figures and having opening 40 for attaching to sleeve 12 and opening 42 for attachment of cap 16 or cap 16A. Neck 14 is preferably made of plastic such as PVC and HDPE and the interior surface is preferably seamless. Neck 14 is attached to sleeve 12 and includes means for attaching cap 16 or cap 16A. Neck 14 includes inside thereof damper 20 and damper ring 22. Referring to FIG. 4B, neck 14 includes four lugs 44 extending outwardly from the inside of neck 14 and adapted to engage twist lock channels 32. Lugs 44 will be inserted into the top portion 34 of twist lock channels 32 and neck 14 will be twisted or rotated such that lugs 44 end up at the bottom portion 38 of channels 32, that is a female to male connection. This will secure neck 14 to sleeve 12 without the use of tools. It will also allow for the easy removal of neck 14 from sleeve 12 for cleaning duct D or for providing access to duct D. Referring to FIGS. 4 and 4A, instructions for taking neck 14 off of sleeve 12 may be included on neck 14. In the alternative, the attachment of neck 14 to sleeve 12 may be made by friction fit, adhesive or other known connection means.

Neck 14 includes inside thereof damper ring 22, preferably eccentric in shape as shown in FIGS. 2, 2A, 6 and 6A. As seen in FIGS. 2 and 2A, damper ring 22 is attached at the bend in neck 14 and away from opening 42. This allows for better air flow and for damper 20 to open within neck 14. Damper ring 22 includes an exterior ring 50 and an interior ring 52. Exterior ring 50 is tapered from the top to the bottom. Damper ring 22 further includes tabs 54 having slots 56 for receiving and connecting damper 20 by means of damper rod 60 as discussed below. Damper ring 22 further includes slots 58 for engaging lugs 46 which extend inwardly from the inside of neck 14. Neck 14 further includes a plurality of posts 47 which may also hold damper ring 22 in place. Accordingly, damper ring 22 is secured inside neck 14 and damper 20 is secured to damper ring 22 by damper rod 60 in slots 56. Damper 20 includes a hinge 62 which allows damper 20 to seat on lip 53 of interior ring 52 when the damper 20 is closed. When venting dryer exhaust through duct D, damper 20 will move to an open position as shown in FIGS. 2 and 2A. When not venting, damper 20 seats on lip 53 of interior ring 52 to close off the exhaust vent system. While damper ring 22 is shown as a separate component of the exhaust vent assembly, it may be made integral with neck 14 without departing from the scope of the invention.

Additionally, other means for securing a damper in neck 14 may be utilized without departing from the scope of the invention. For example, neck 14 may include two slots and damper 20 may include rods for mating in the slots. The damper, therefore, fits inside neck and is attached in neck by the rods engaging the slots. The exhaust airflow will open the damper allowing the exhaust air to exit through the vent. Similarly, when the exhaust device is not on, the damper will close to prevent inflow of air.

Referring again to FIGS. 4, 4A and 4B, neck 14 includes threads 45 for attaching cap 16 or cap 16A. Neck 14 further includes four T-shaped members 48 extending outwardly therefrom which may be useful in attaching neck 14 to sleeve 12. For example, the top of T-shaped member 48 includes a portion 47 for pushing the neck 14 down onto sleeve 12 and a portion 49 for twisting neck 14 to secure lugs 44 to twist channels 32.

Neck 14 is adapted to be rotated on sleeve 12 360 degrees, in 90 degree increments based on the four lugs 44 and four twist lock channels 32. This will allow a contractor installing the exhaust vent 10 to move the neck 14 to a preferred position, including taking into consideration other exhaust vents on the roof or other equipment on the roof.

Figure 7:
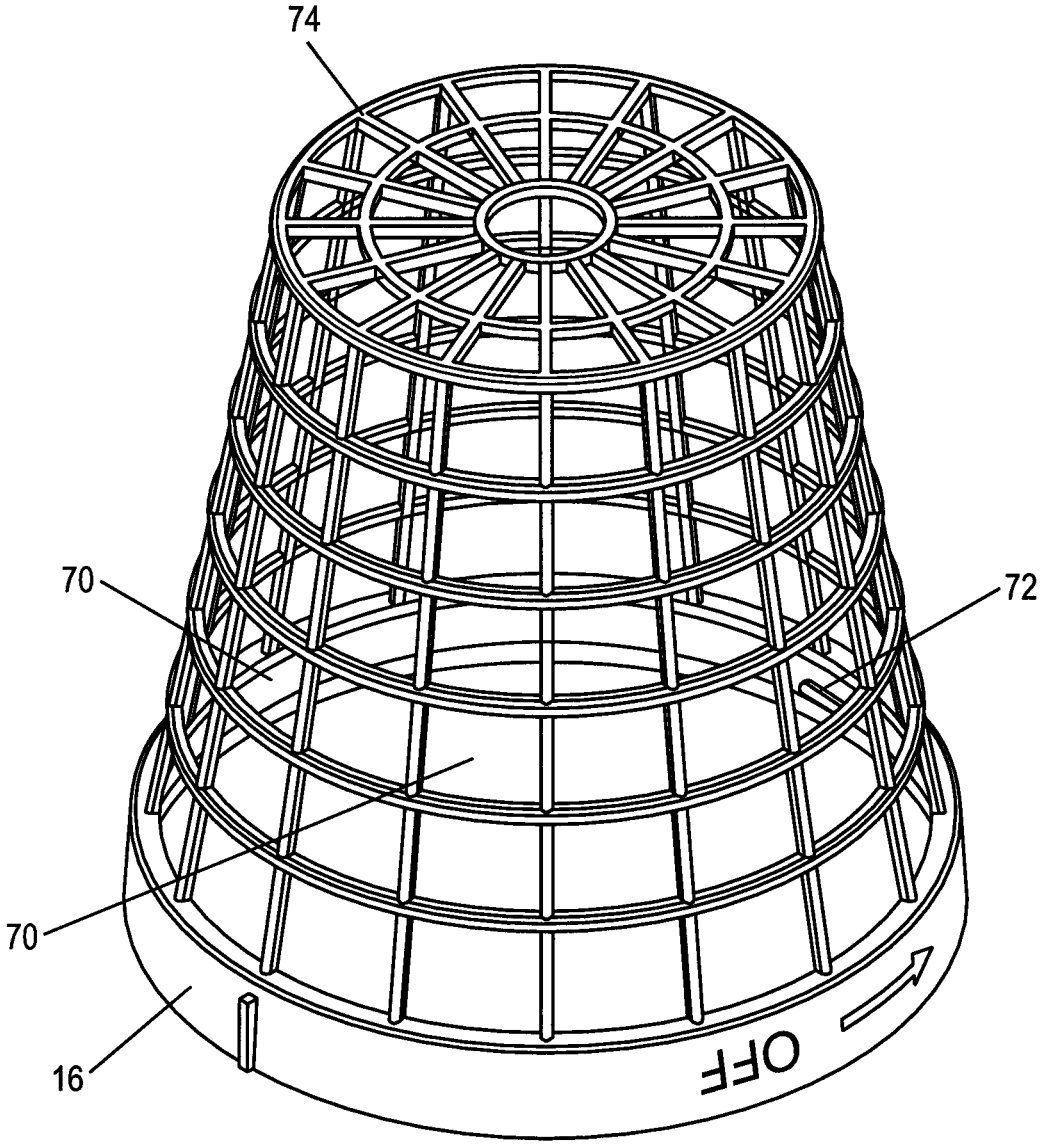
FIG. 7 shows the cap of the exhaust vent of FIG. 1.

Referring to FIGS. 1, 2 and 7, there is shown a cap 16. Cap 16 serves to allow venting of the exhaust through a plurality of openings 70 and to prevent entry by birds or the like. Cap 16 is attached to neck 14 by screw threads 45 on neck 14 and corresponding threads 72 on cap 16. In a presently preferred embodiment, cap 16 is generally cylindrically shaped with a flat end 74. However, it is understood that other shapes may be used without departing from the scope of the invention. Cap 16 is preferably made of plastic such as PVC or HDPE. Like the other components of exhaust vent 10, cap 16 may easily be connected and removed from neck 14 without tools, simply by screwing cap 16 on or off. Cap 16 is preferably used for venting a dryer exhaust. Cap 16 in conjunction with neck 14 provides for a large area for exhaust emission, thereby meeting IMC requirements.

As an alternative to cap 16 and for other venting purposes, cap 16 may be replaced with cap 16A as shown in FIG. 8. Cap 16A includes internal threads 72A for attaching to neck 14. Cap 16A will include a screen 80 (partially shown) to prevent the entrance of insects or the like. The screen 80 may be of a material and size commensurate with the exhaust requirements. Cap 16A is preferably made of plastic such as PVC or HDPE.

Figure 9:
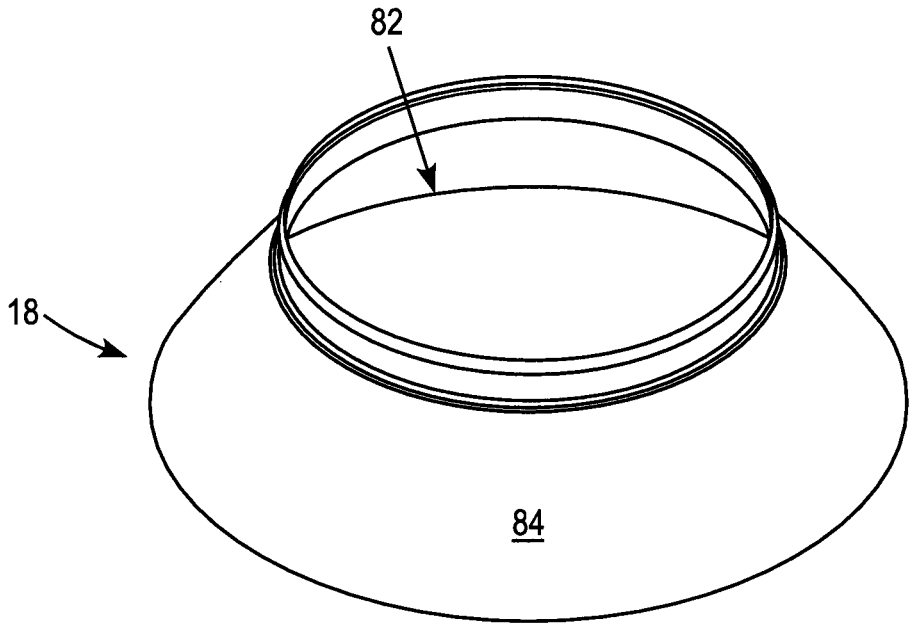
FIG. 9 shows the storm collar of the exhaust vent of FIG. 1.

Referring to FIG. 9, there is shown a storm collar 18 which fits over sleeve 12 and is held in place by a friction fit. Collar 18 is annular and includes an opening 82 for fitting over sleeve 12 and a sloped wall 84. Collar 18 is adapted to be adjacent to the roof R and provides for protection from rain and the elements. Storm collar 18 is preferably made of plastic such as PVC or HDPE.

Referring to FIGS. 2, 2A, 2B and 10, there is shown a bushing 24. As noted above, this bushing 24 is useful when a space S is desired between duct D and sleeve 12. Bushing 24 includes an annular collar 90 and tabs 92. Collar 90 includes a top 94, bottom 96, lip 98, groove 100, slots 102 and apertures 104. Referring to FIG. 2B, the bushing 24 is placed over duct D, top 94 seats on roof R, and tabs 92 extend upwardly and adjacent to the exterior wall of duct D and collar 90 engages the inside wall of sleeve 12. Apertures 30 of sleeve 12 overlie groove 100 for allowing strapping to engage groove 100. The bottom of sleeve 12 seats on lip 98. Bushing 24 thereby creates space S between duct D and sleeve 12. Referring to FIG. 2A, the bushing 24 is secured adjacent the interior wall of sleeve 12 with tabs 92 extending downward on the outside wall of duct D. Collar 90 fits snuggly into sleeve 12 and lip 98 seats on top of sleeve 12. This also provides for space S between duct D and sleeve 12. Apertures 104 may be used to insert fasteners to secure bushing 24 into roof R, usually when retrofitting the exhaust vent to an existing structure. As noted above, insulation I may be inserted into space S to provide for an insulated exhaust vent, the insulation being partially shown in FIG. 2. An insulated exhaust vent is especially useful when venting a dryer. Additionally, as stated above, this space S provides a larger neck 14 providing for greater airflow, thereby meeting the requirements of IMC.

As noted above in the preferred embodiment of exhaust vent 10, all of the assembly components are plastic and the exhaust vent may be assembled without tools and without penetrative fasteners. The exhaust vent 10 may be made of a specific color with all of the components color coordinated. Besides the ease of installing exhaust vent 10 and the cost saving, the exhaust vent provides an aesthetically pleasing appearance.

As seen above, the present invention solves a number of problems of the prior art exhaust vents in a unique manner. For example, it weatherproofs and counter-flashes existing or new construction ducts for flat roofs. The exhaust vent 10 may be easily retrofitted on older projects; and it provides a back-draft damper and a bird proof assembly for dryer ducts on a flat roof. The plastic neck 14 is preferably one piece having a uniform seamless radius throughout such that there is minimal restriction or friction on the air flow. The cap 16 or cap 16A screws onto neck 14 such that no tools are required. For a bathroom exhaust, one may use cap 16A as opposed to cap 16. The caps 16 and 16A are readily removable making cleaning easy. Additionally, cap 16 is believed to be self-cleaning due to its position being exposed to wind and rain, and there are no known self-cleaning dryer vent bird guards. The exhaust vent 10 is adjustable for different height exhaust ducts, e.g. the plastic sleeve 12 may be cut down for lower duct application. Due to the exhaust vent's light weight, it does not require additional duct support like field designed assemblies that exert leverage due to their weight cantilevering away from the vertical duct riser. Due to the plastic seamless construction, there are no screws in the air-stream, unlike conventional hoods that need to be fastened to the duct or metal venting.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. An exhaust vent assembly for use with an exhaust duct on a flat roof for exhaust from a bathroom, kitchen or clothes dryer wherein the exhaust duct extends upwardly and beyond said flat roof, the exhaust vent comprising:

a plastic sleeve adapted to overlie said exhaust duct extending upwardly and beyond said flat roof, a plastic neck having a gooseneck configuration adapted to attach to an upper end of said plastic sleeve, a plastic damper constructed and arranged inside said plastic neck and adapted to move from a closed position to an open position in response to emission of said exhaust, a plastic cap adapted to be attached to an outer end of said plastic neck, wherein the plastic cap comprises a substantially cylindrical shape having a plurality of openings distributed around a circumference thereof adapted to emit said exhaust and to prevent entry of birds, and a plastic collar adapted to fit over said plastic sleeve and adjacent to said roof, wherein said exhaust vent assembly is adapted to be configured without penetrative fasteners.

2. The exhaust vent assembly of claim 1 further comprising a plastic damper ring attached to the inside of said plastic neck and adapted to receive said plastic damper.

3. The exhaust vent assembly of claim 2 wherein said plastic damper ring is eccentric in shape.

4. The exhaust vent assembly of claim 1 where said plastic cap is removably engaged with said neck, so as to be replaceable with a plastic cap comprising an annular ring having a screen adapted to prevent entry of insects.

5. The exhaust vent assembly of claim 2 where said plastic cap is removably engaged with said neck, so as to be replaceable with a plastic cap comprising an annular ring having a screen adapted to prevent entry of insects.

6. The exhaust vent assembly of claim 1 wherein said plastic sleeve includes a plurality of apertures at the bottom thereof adapted to receive a clamping band to secure said plastic sleeve to said exhaust duct and a plurality of locking channels at the top thereof adapted to receive a plurality of locking lugs on the interior of said plastic neck.

7. The exhaust vent assembly of claim 6 wherein said plurality of apertures are in alignment with said plurality of locking channels to allow uniform installation of a plurality of the exhaust vent assemblies.

8. The exhaust vent assembly of claim 1 further comprising at least one plastic bushing adapted to fit over said exhaust duct and engage the exterior wall of said exhaust duct and engage the inner wall of said plastic sleeve to create a space between said exhaust duct and said plastic sleeve.

9. The exhaust vent assembly of claim 8 including two plastic bushings attached at each end of said plastic sleeve.

10. The exhaust vent assembly of claim 9 wherein said space between said exhaust duct and said plastic sleeve includes insulation therein.

11. An exhaust vent assembly for use with an exhaust duct on a flat roof for exhaust from a bathroom, kitchen or clothes dryer, the exhaust vent comprising:

a plastic sleeve adapted to overlie said exhaust duct wherein said plastic sleeve includes a plurality of apertures at the bottom thereof adapted to receive a clamping band to secure said plastic sleeve to said exhaust duct and a plurality of locking channels at the top thereof adapted to receive a plurality of locking lugs on the interior of a plastic neck, a plastic neck having a gooseneck configuration adapted to attach to an upper end of said plastic sleeve, a plastic damper constructed and arranged inside said plastic neck and adapted to move from a closed position to an open position in response to emission of said exhaust, a plastic damper ring attached to the inside of said plastic neck and adapted to receive said plastic damper and being eccentric in shape, a plastic cap adapted to be attached to an outer end of said plastic neck, at least one plastic bushing adapted to fit over said exhaust duct and engage the exterior wall of said exhaust duct and engage the inner wall of said plastic sleeve to create a space between said exhaust duct and said plastic sleeve, and a plastic collar adapted to fit over said plastic sleeve and adjacent to said roof, wherein said exhaust vent assembly is adapted to be configured without penetrative fasteners.

12. The exhaust vent assembly of claim 11 wherein said plastic cap comprises a cylindrical shape having a plurality of openings adapted to emit said exhaust and to prevent entry of birds.

13. The exhaust vent assembly of claim 11 where said plastic cap comprises an annular ring having a screen adapted to prevent entry of insects.

14. The exhaust vent assembly of claim 11 including two plastic bushings attached at each end of said plastic sleeve.

15. The exhaust vent assembly of claim 14 wherein said space between said exhaust duct and said plastic sleeve includes insulation therein.

* * * * *